US007797793B2

(12) United States Patent
Roschi et al.

(10) Patent No.: US 7,797,793 B2
(45) Date of Patent: Sep. 21, 2010

(54) MECHANISM FOR MOVING A WIPING/RAISING INSERT OF A SUCTION NOZZLE FOR A VACUUM CLEANER

(75) Inventors: Riccardo Roschi, Varese (IT); Ermes Roschi, Varese (IT)

(73) Assignee: New Ermes Europe S.p.A., Albizzate (Varese) (IT)

( * ) Notice: Subject to any disclaimer, the term of this patent is extended or adjusted under 35 U.S.C. 154(b) by 1455 days.

(21) Appl. No.: 11/139,994

(22) Filed: May 31, 2005

(65) Prior Publication Data

US 2005/0262659 A1 Dec. 1, 2005

(30) Foreign Application Priority Data

May 28, 2004 (IT) ..... MI2004A1075

(51) Int. Cl.
*A47L 5/00* (2006.01)

(52) U.S. Cl. ..... 15/368

(58) Field of Classification Search ..... 15/367, 15/368, 371, 373, 398, 400; *A47L 9/06*
See application file for complete search history.

(56) References Cited

U.S. PATENT DOCUMENTS 4,777,696 A * 10/1988 Hawley et al. ..... 15/373
5,539,953 A * 7/1996 Kurz ..... 15/367
7,251,856 B2 * 8/2007 Kaffenberger et al. ..... 15/373
2002/0083552 A1 * 7/2002 Dilger et al. ..... 15/373
2005/0132605 A1 * 6/2005 Jensen et al. ..... 34/618

FOREIGN PATENT DOCUMENTS

| | | | |
|---|---|---|---|
| DE | 10307176.8 | * | 2/2003 |
| EP | 0 552 652 | A | 7/1993 |
| EP | 0 630 604 | A | 12/1994 |
| EP | 0 909 548 | A | 4/1999 |
| EP | 1 238 620 | A | 9/2002 |

OTHER PUBLICATIONS

EP Search Report complete May 2, 2005 in corresponding IT application No. IT MI20041075.

* cited by examiner

*Primary Examiner*—Joseph J Hail, III
*Assistant Examiner*—Jamal Daniel
(74) *Attorney, Agent, or Firm*—Nixon & Vanderhye, P.C.

(57) ABSTRACT

An improved mechanism for moving a wiping/raising insert of a suction nozzle for a vacuum cleaner is described. The suction nozzle comprises a base plate. The mechanism for moving the insert comprises an operating pedal and a frame for supporting the insert and for bringing this insert from a first working position into a second rest position. The pedal is rotatable about a first axis of rotation and the frame is rotatable about a second axis of rotation. According to the invention, the first and the second axis of rotation lie in a plane inclined at an angle α ranging between 80° and 100° with respect to a plane of the base plate.

13 Claims, 9 Drawing Sheets

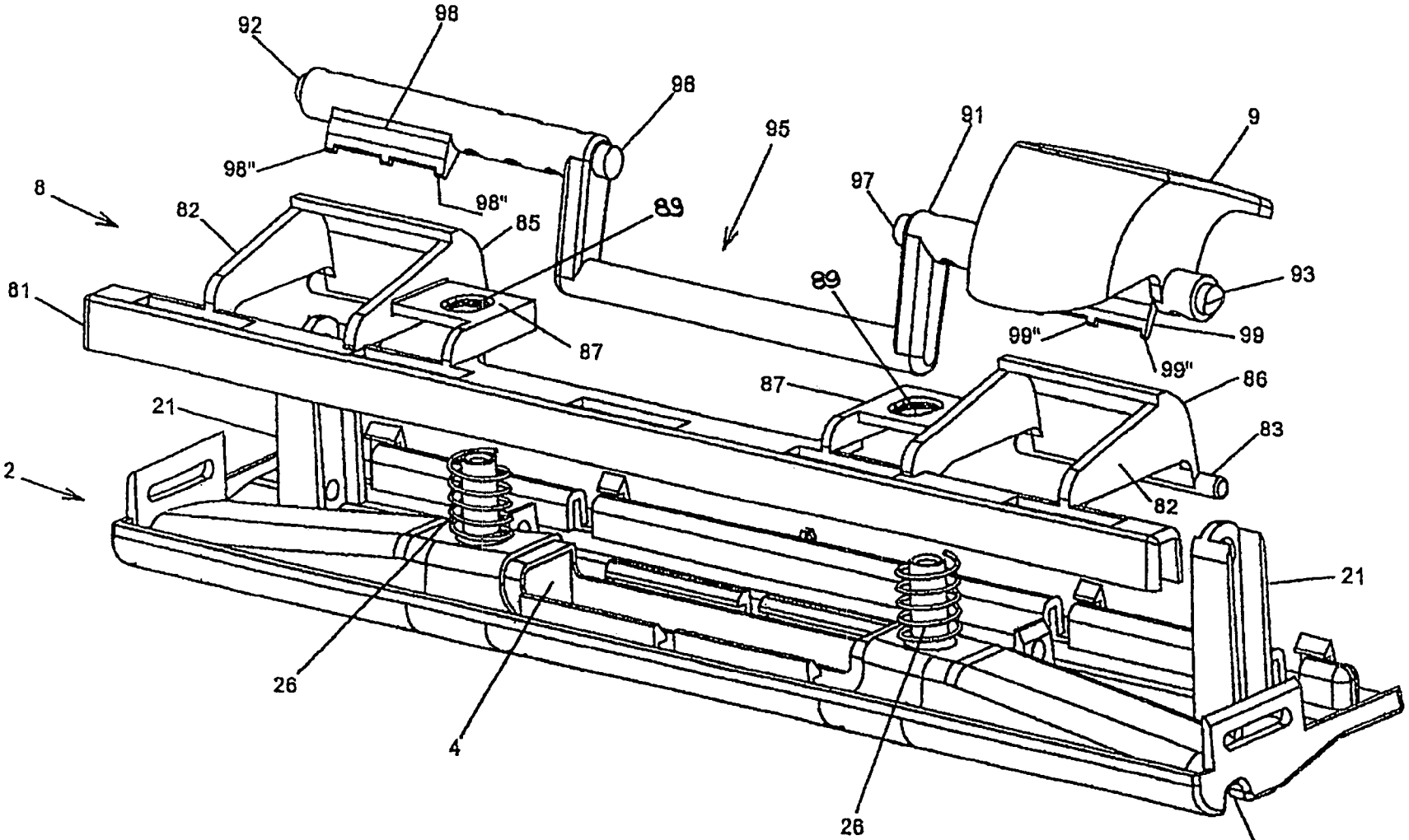
Fig. 1.1

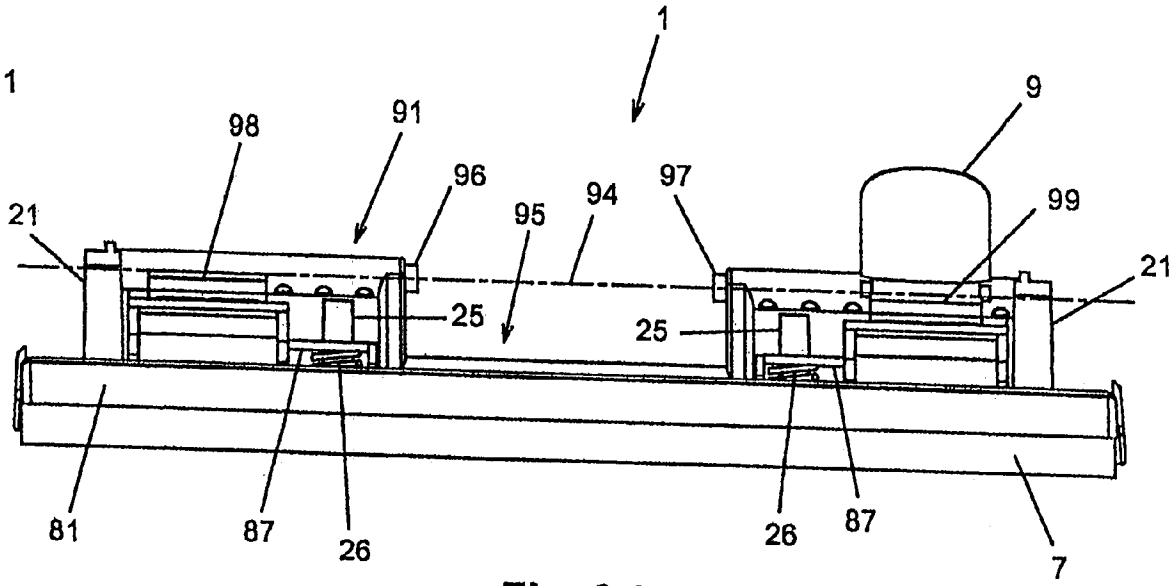
Fig. 2.2
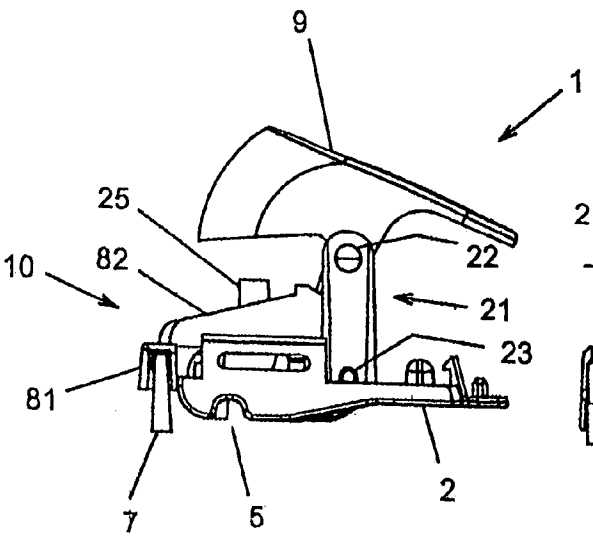
Fig. 2.1

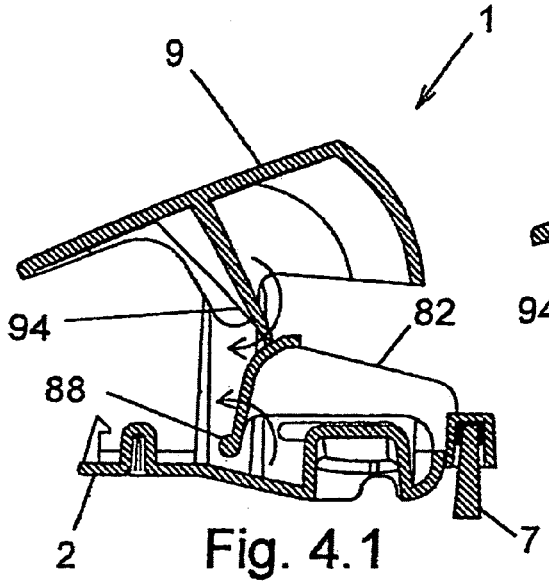
Fig. 4.1
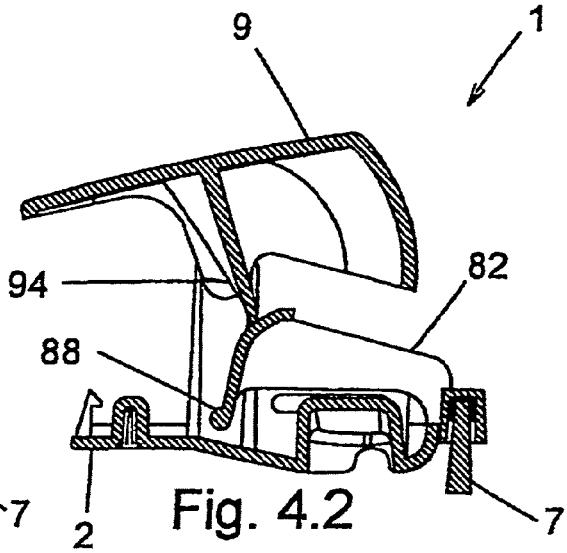
Fig. 4.2
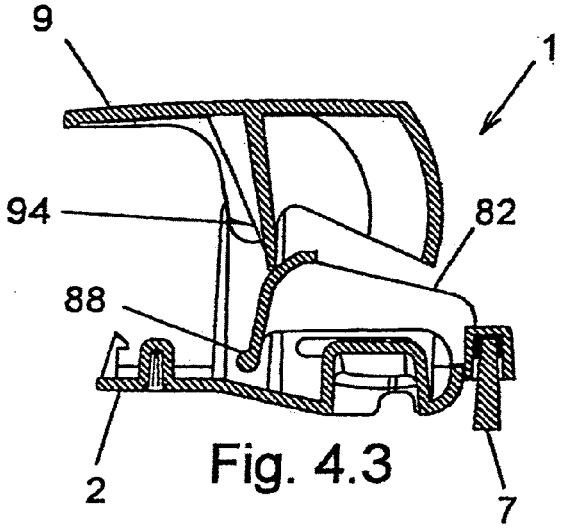
Fig. 4.3
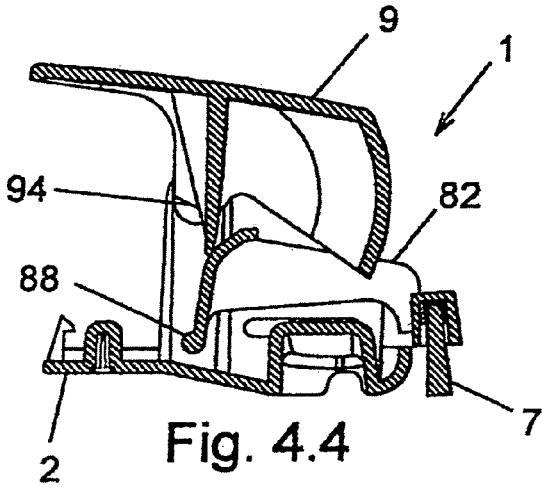
Fig. 4.4
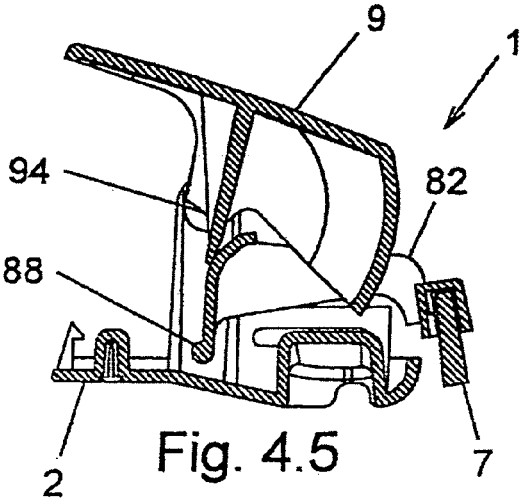
Fig. 4.5
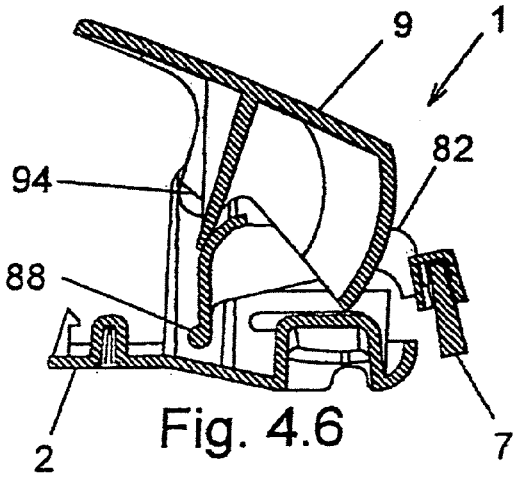
Fig. 4.6

MECHANISM FOR MOVING A WIPING/RAISING INSERT OF A SUCTION NOZZLE FOR A VACUUM CLEANER

This application is a new U.S. patent application that claims benefit of IT MI2004A 001075, filed 28 May 2004, the entire contents of each of which are hereby incorporated by reference.

SUMMARY

Background

I. Field of the Invention

The present invention relates to the sector of electric household appliances for cleaning by means of suction, such as for example vacuum cleaners, electric brushes or so-called multi-purpose hoovers, for sucking dust and/or fluids and/or waste from a surface. In particular, the present invention relates to an improved mechanism for moving a wiping/raising insert of a suction nozzle for these electric household appliances.

II. Related Art and Other Considerations

As is known, a vacuum cleaner, an electric brush or a similar electric household appliance for cleaning by means of suction comprises a suction nozzle for sucking up dust and waste from a surface. In the field of electric household appliances, a suction nozzle is generally defined by the term "brush". For the purposes of the present description, therefore, the terms "suction nozzle" and "brush" or "vacuum cleaner brush" are considered to be substantially equivalent. Still for the purposes of the present invention, the term "vacuum cleaner" will be used with a wider meaning so as to include all the apparatus, for professional or domestic use, which perform cleaning by means of suction. Therefore, the term "vacuum cleaner" will comprise a vacuum cleaner, an electric brush, a so-called multi-purpose hoover and a steam supply and suction apparatus.

In general terms, a vacuum cleaner brush comprises a base plate which is shaped so as to have at least one base plate channel open towards a surface to be cleaned and a curved suction duct in fluid communication with the base plate channel. On the other side (outlet end) the suction duct communicates with a suction tube by means of a joint. Usually, but not necessarily a covering body is fixed at the top. The suction duct is usually integral with the base plate or the covering body.

In order to perform vacuum cleaning of a substantially rigid and smooth surface, such as a floor which is tiled or made of marble or parquet, the brush must be slightly raised from the surface in order to prevent it from "sticking" to the said surface owing to the vacuum created by the suction system and in order to prevent damage both to the surface to be cleaned and to the plate of the brush. For this reason, in some known suction nozzles, a special raising member comprising a wiping insert is provided. For the purposes of the present patent application, the term "insert" will be understood as meaning a bar provided with bristles (generally synthetic or comprising natural horsehair or metal), a strip of rubber or plastic, a fabric-lined strip, velvet ribbon, felt, foam rubber or the like. Owing to this special member it is possible to provide a wiping as well as raising action in order to ensure more effective cleaning of the surface.

Since raising, and likewise the wiping action, is not always necessary (the latter is not required, for example, when a carpet or rug is cleaned), a mechanism is usually envisaged for recalling the insert into a position where it substantially does not make contact with the surface to be hoovered. The same mechanism is able to bring back the insert into contact with the surface to be cleaned if the user should so wish in order to make cleaning of a substantially smooth and hard surface possible.

The mechanisms for moving the wiping/raising insert are generally operated by means of a pedal projecting from the body of the brush.

Different mechanisms for moving the wiping/raising insert are known. In particular, mechanisms where the pedal, pivotably mounted about an axis of rotation thereof, causes rotation of the insert about an axis situated in front of (or behind) the vertical of the axis of rotation of the said pedal.

The known mechanisms of this type have various drawbacks. Firstly, they are somewhat noisy to operate. In fact, the transition from a condition where the insert is raised to a condition where it is lowered involves overcoming a tooth and therefore results in an annoying clicking action. In other words, the movement of the mechanisms is far from what one would call "fluid".

Secondly, the Applicant has found that, in the known mechanisms, there is a not insignificant amount of wear in the zone of contact between the pedal and the frame which supports the insert owing to the high resilient recall force.

Thirdly, owing to the abovementioned high resilient recall force, the user of the known brushes must apply fairly high loads in order to lower the insert so that it is in contact with the surface to be cleaned.

Finally, the Applicant has found that any knocking of the brush, for example against a wall, in the configuration where the insert is lowered may cause the latter to jump into a position where it is no longer in contact with the surface. This annoying drawback could be overcome by increasing the dimensions of the tooth, but this would accentuate the problems mentioned above.

An object of the technology disclosed herein is an improved mechanism for moving a wiping/raising insert of a vacuum cleaner brush which has a fluid movement, without clicking actions, and which can therefore be operated in a more silent manner.

A further object of the technology disclosed herein is an improved mechanism for moving a wiping/raising insert of a vacuum cleaner brush which can be operated by applying a relatively small force on the pedal and which is more reliable than the known mechanisms.

According to the technology disclosed herein, an improved mechanism for moving a wiping/raising insert of a suction nozzle for a vacuum cleaner is provided. The suction nozzle comprises a base plate. The mechanism for moving the insert comprises an operating pedal and a frame for supporting the insert and for bringing this insert from a first working position into a second rest position. The pedal is rotatable about a first axis of rotation and the frame is rotatable about a second axis of rotation. The first and the second axis of rotation lie in a plane inclined at an angle $\alpha$ ranging between 80° and 100° with respect to a plane of the base plate.

According to a preferred embodiment, the plane in which the first and the second axes of rotation lie is substantially perpendicular to a base plate plane.

Conveniently, the pedal is connected to a first axis of rotation and the first axis of rotation comprises at least one projecting tongue, preferably a pair of projecting tongues.

Preferably, the projecting tongues have a thickness which tapers towards the free end and have a terminal edge.

The frame comprises a guide inside which the insert is seated, a second rotational shaft, brackets for connecting said second shaft to said guide and at least one engaging surface able to cooperate with said at least one tongue. Preferably, two engaging surfaces are provided for cooperating with two corresponding flanges. Each engaging surface extends between two brackets.

Preferably, the frame comprises holed plates cooperating with centring pins of the base plate. Conveniently the mechanism according to the invention comprises resilient members cooperating with said centring pins and with said holed plates, in order to keep said insert raised in its rest position.

Preferably, said second shaft of the frame comprises two shaft sections. Conveniently, the first and the second shaft are pivotably mounted in respective holes formed in pillars on the base plate, the second shaft being also pivotably mounted on further intermediate supports.

The first shaft is substantially in the form of a cam shaft with a central crank.

BRIEF DESCRIPTION OF THE DRAWINGS

The present invention will become clear from the detailed description which follows, provided purely by way of a non-limiting example, with reference to the accompanying drawings, in which:

FIG. 1.1 is an exploded view of the suction nozzle according to FIG. 1, without the suction duct;

FIG. 2.1 is a side view of the suction nozzle according to FIG. 2;

FIG. 2.2 is a front view of the suction nozzle according to FIG. 2;

FIGS. 4.1-4.6 are cross-sectional views which show the mechanism according to the invention in several configurations;

Figure 1:
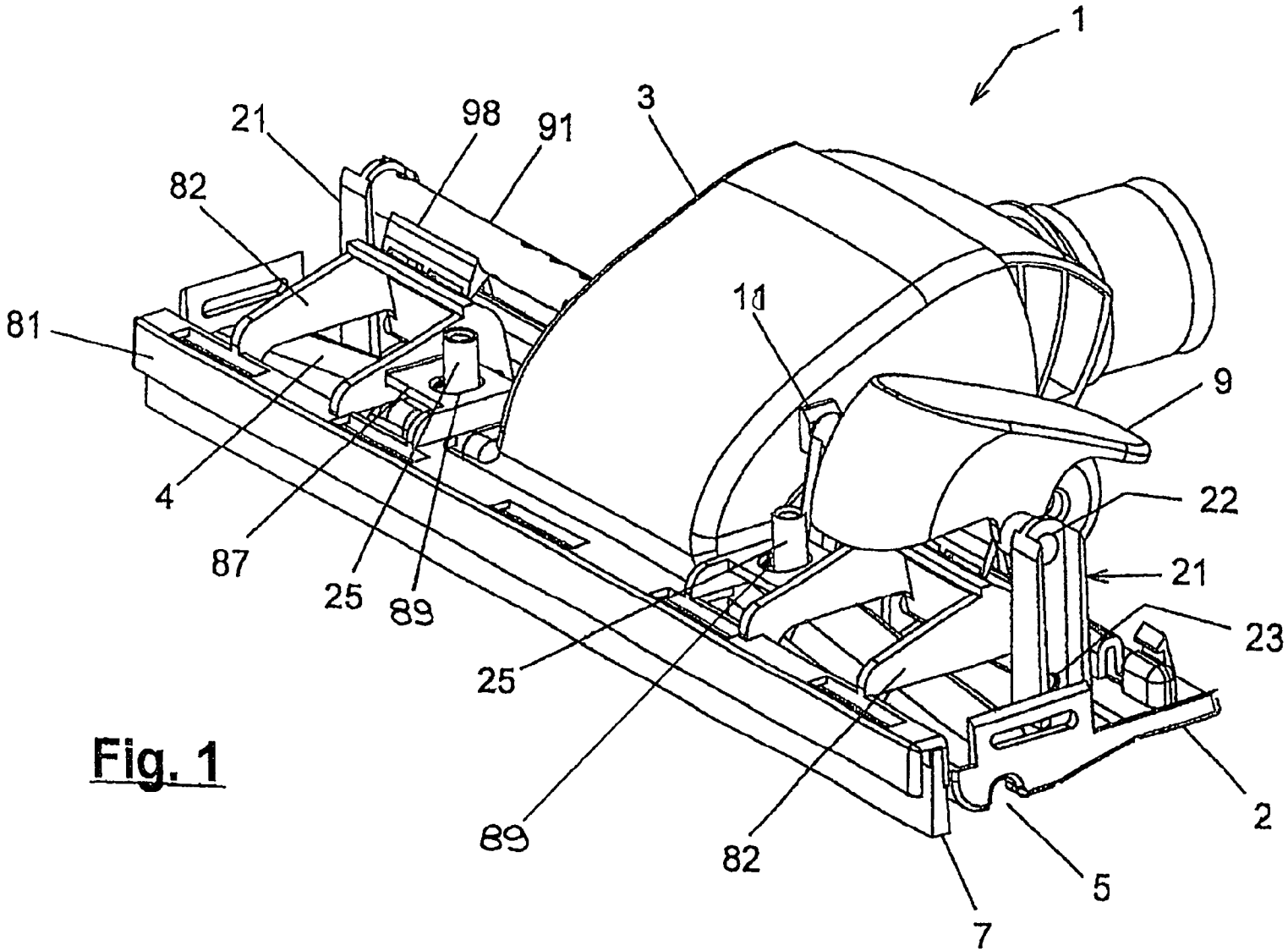
FIG. 1 is an axonometric view of a suction nozzle according to an example embodiment, without the body and with the insert lowered in the working position.
Figure 2:
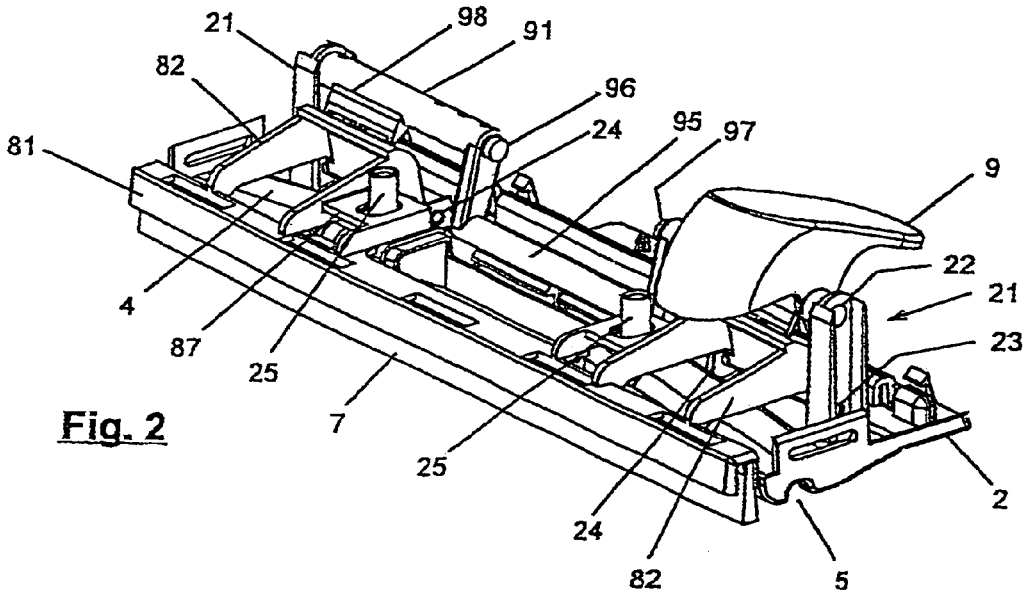
FIG. 2 is an axonometric view similar to FIG. 1, but without a suction duct for greater clarity and on a smaller scale.
Figure 3:
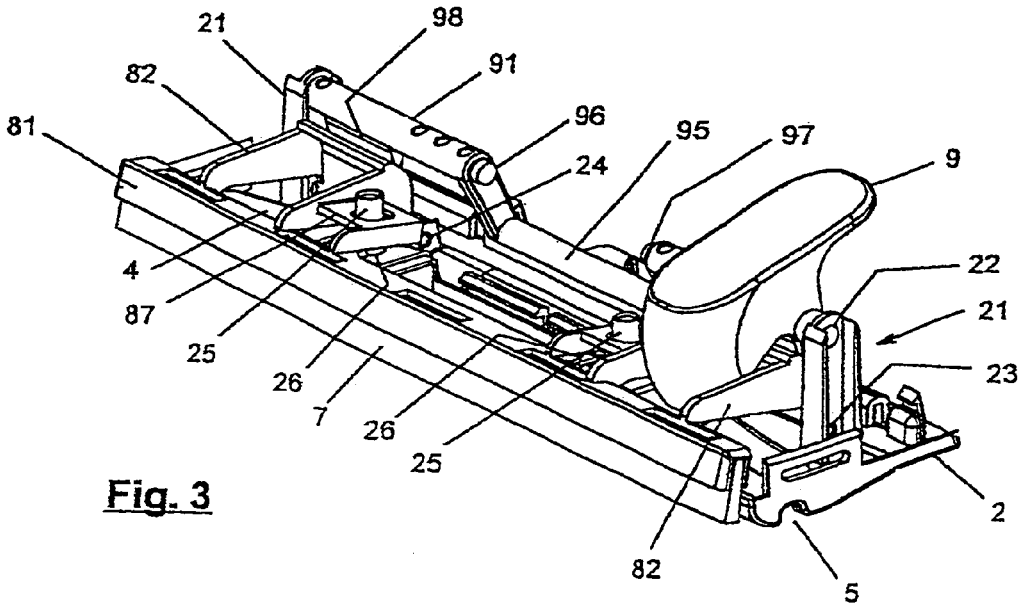
FIG. 3 is an axonometric view similar to FIG. 2, but with the insert raised.

A suction nozzle 1 (or brush) 1 for a vacuum cleaner comprises a base plate 2 and a suction duct 3. Generally it also comprises a covering body. In the various figures, the covering body has not been shown for the sake of clarity.

DETAILED DESCRIPTION

The base plate 2 is shaped so as to comprise a base plate channel 4 which is substantially in the form of an overturned "U" open towards the surface to be cleaned and with small openings 5 at its side ends.

The base plate channel 4 is in fluid communication with the curved tubular suction duct 3, the outlet end of which communicates with a suction tube and a suction system (not shown). Usually, the suction duct 3 is integral with the base plate 2 or the body (not shown).

A brush 1 with its base plate resting directly on a surface to be cleaned is able to suck up dust, waste, fluids and other materials from a substantially non-rigid surface such as a carpet or a rug. In order to clean a surface which is substantially smooth, flat and rigid 6 (for example a floor which is tiled, made of marble, parquet or the like) it is necessary to raise the base plate 2 so as to prevent it from "sticking" to the said surface, with consequent loss of the suction characteristics and a considerable increase in the force required to move the said brush. When the brush rests directly on a rigid surface, there is also the risk of damaging both the floor and the brush. For this purpose, it is known to provide a special wiping/raising insert 7.

When the insert 7 is in its working position, the brush rests substantially on the insert and therefore substantially on the end of the bristles, the rubber or plastic strip or on fabric, velvet ribbon, felt, foam rubber or the like. In other words, when the insert is lowered, the base plate 2 is slightly raised from the surface 6 to be cleaned; on the contrary, when it is raised (rest position), the base plate 2 slides directly on top of the surface to be cleaned 6.

Figure 11:
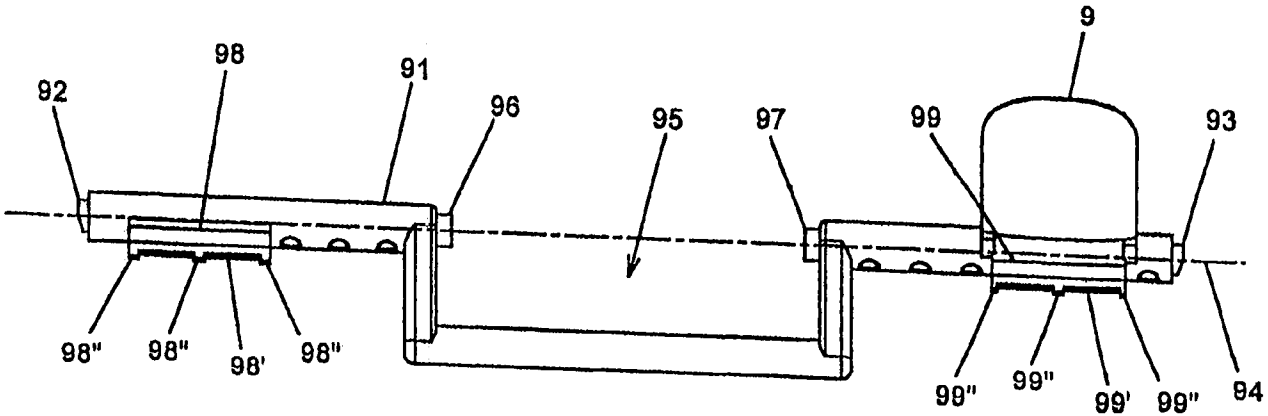
FIG. 11 is a plan view, from above, of the pedal and the first shaft.
Figure 10:
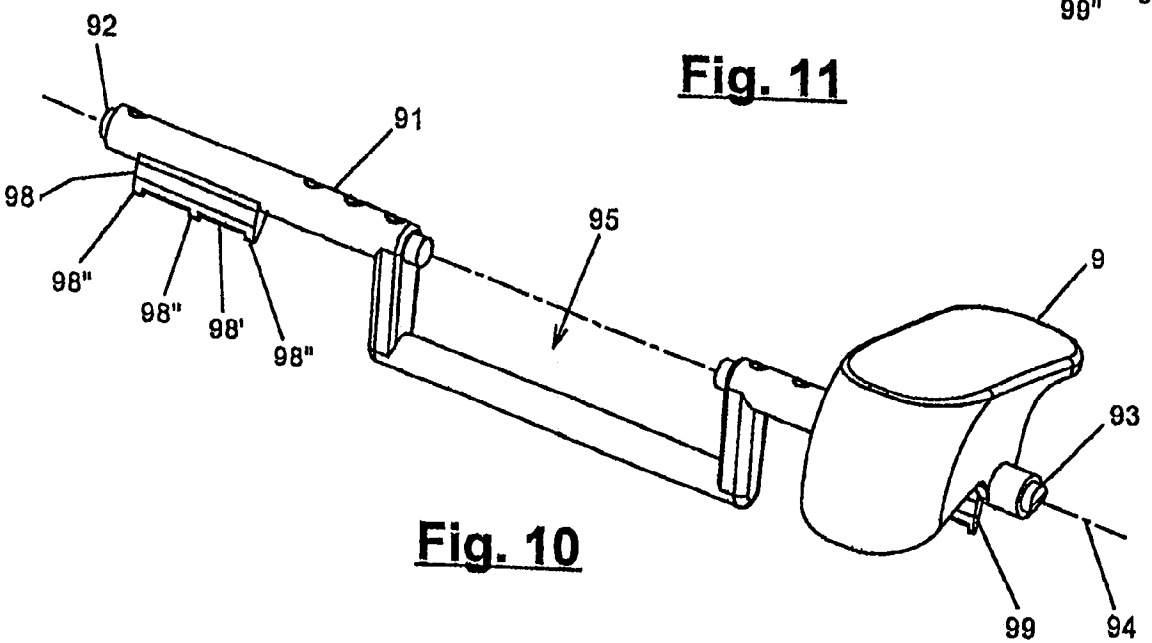
FIG. 10 is an axonometric view of the pedal and the first shaft.
Figure 12:
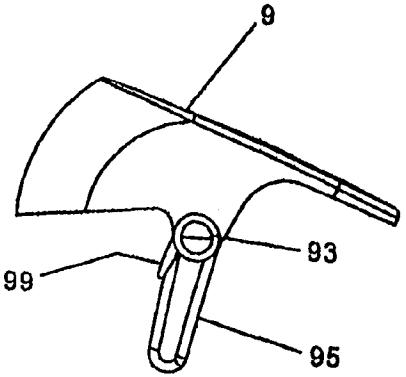
FIG. 12 is a side view of the pedal and the first shaft.

According to an example embodiment, an improved mechanism 10 is provided for moving the wiping/raising insert 7. The mechanism 10 according comprises an operating pedal 9 and a frame 8 for supporting the insert 7. In the embodiment shown, the operating pedal 9 is integral with a first shaft 91 having a first and a second end 92, 93 which define a first axis of rotation 94. In particular, the pedal 9 is fixed in the vicinity of the second end 93 of the shaft 91. The pedal shaft 91, which is more clearly shown in FIGS. 10, 11 and 12, is formed with a central crank 95 so that it may be able to rotate below/above the suction duct 3. Pivoting points 96, 97 are provided in the region of the central crank 95 for supporting centrally the first shaft 91. The crank pivoting points 96, 97 are rotatable on respective supports 11 on the end walls of the suction duct 3 (FIG. 1).

At the two ends 92, 93 of the first shaft 91 there are two corresponding projecting tongues 98, 99 which have a thickness which tapers towards the free end and have a terminal edge 98', 99', respectively. Even more preferably, the terminal edge of each tongue comprises at least one terminal edge protuberance 98", 99". FIGS. 10 and 11 show three equidistant protuberances 98", 99", which offer a reduced terminal edge surface area. In the embodiment shown in the various figures, each tongue 98, 99 has a length of about 2.0-3.0 cm. The tongues 98, 99, in particular the respective terminal edges 98', 99' define a first meshing means. Conveniently, the pedal 9, the first shaft 91 and the tongues 98, 99 are formed as one piece obtained by means of injection-moulding of a plastic material type ABS or the like.

Figure 6:
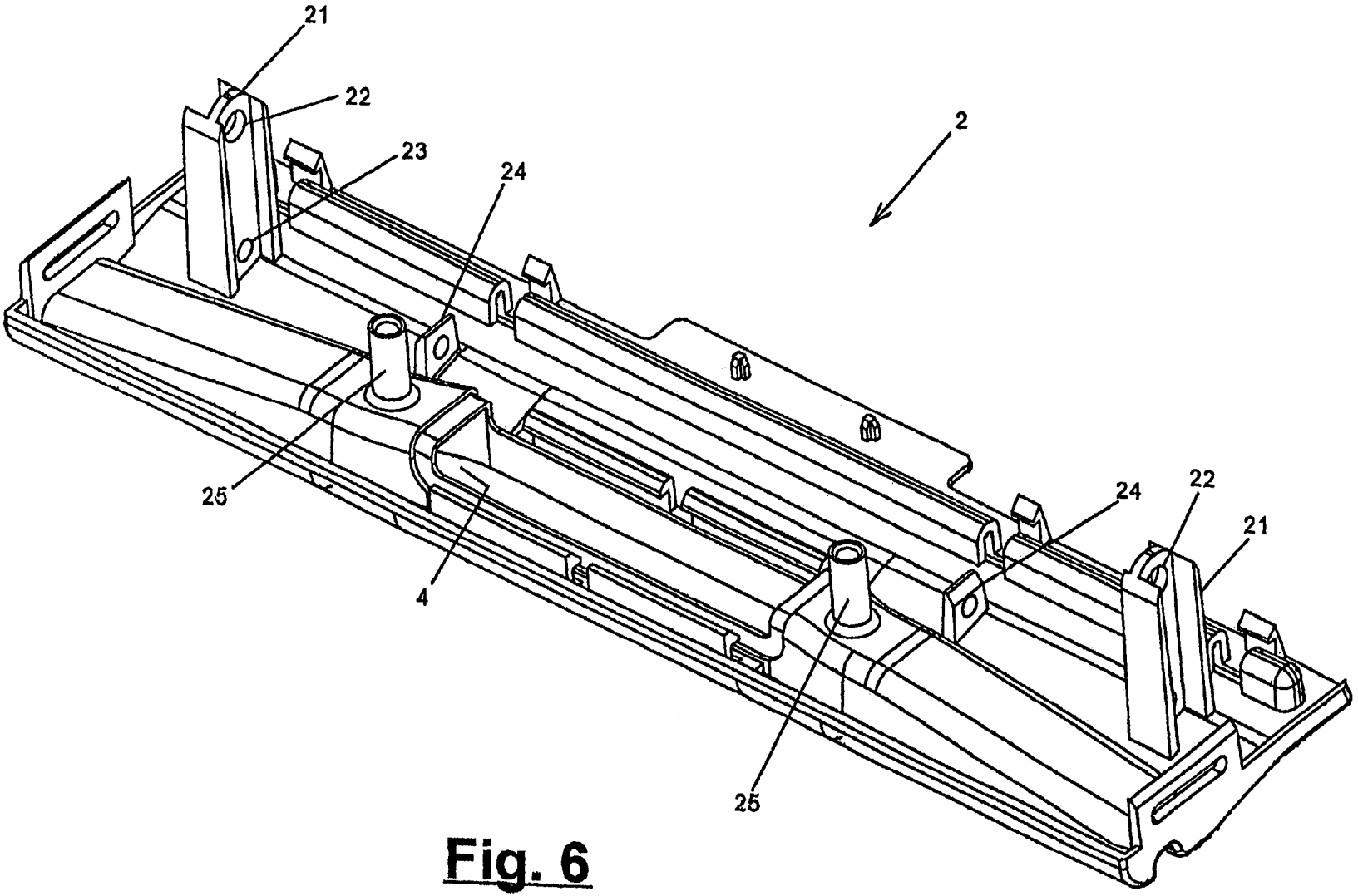
FIG. 6 is an axonometric view of the base plate alone.

With reference in particular to FIG. 6, the base plate 2 comprises two support pillars 21 projecting upwards (towards the body, not shown, of the suction nozzle 1). Each support pillar 21 comprises a first hole 22 for engaging with one of the ends 92, 93 of the shaft of the pedal 91. Conveniently, the said pillar 21 comprises a second hole 23 for engaging with a second shaft 83 to be described below. The base plate 2 also comprises two further supports 24 for supporting and guiding the second shaft 83. Finally, the base plate comprises two centering pins 25. The pins 25 align and guide resilient members 26 to be described hereinbelow.

Figure 7:
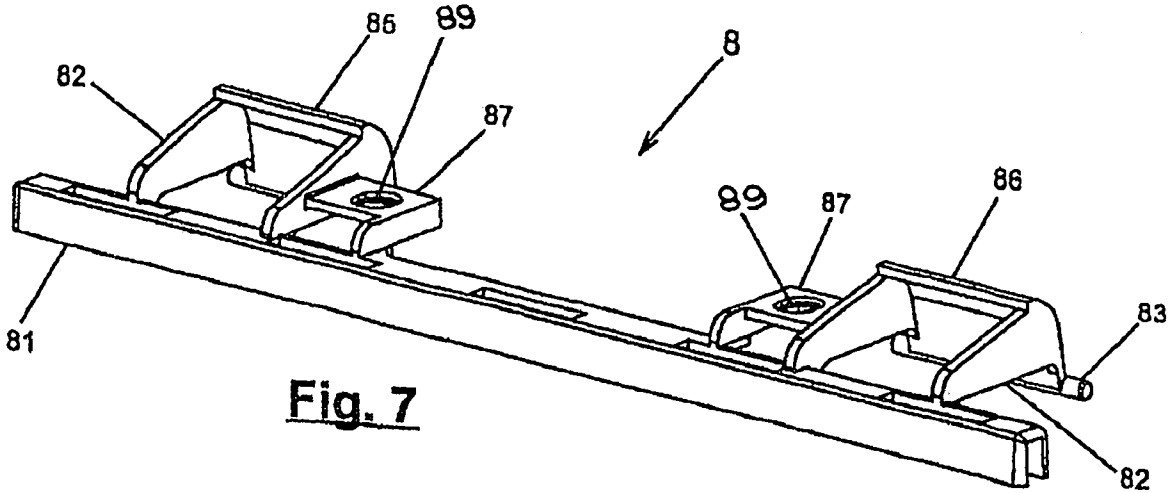
FIG. 7 is an axonometric view of the frame.
Figure 8:
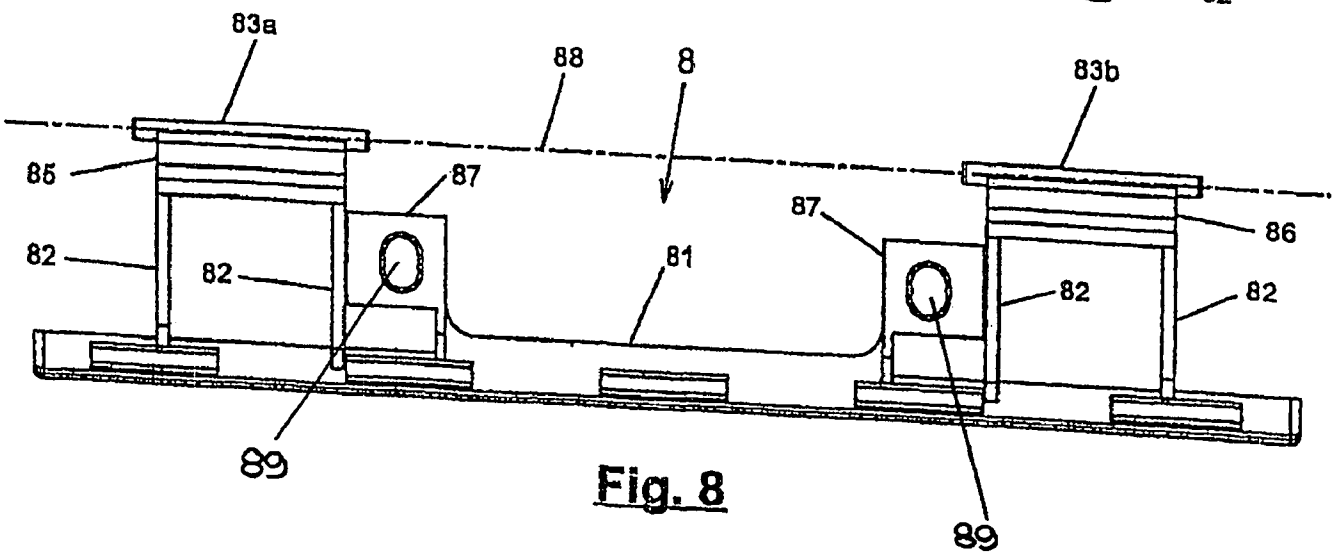
FIG. 8 is a plan view, from above, of the frame.
Figure 9:
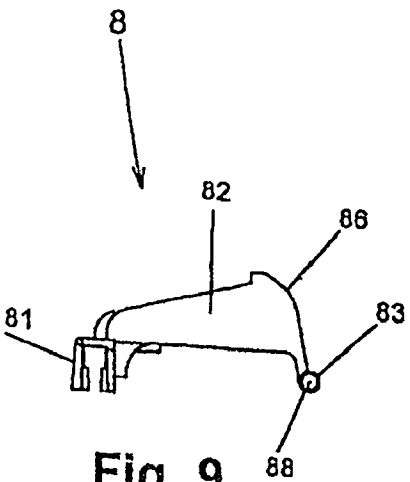
FIG. 9 is a side view of the frame.

With reference in particular to FIGS. 7, 8 and 9, the frame 8 for supporting the insert 7 comprises an elongated guide 81, a first and a second pair of brackets 82, a second shaft 83, two engaging surfaces 85, 86 and two holed plates 87. The elongated guide 81 has a C-shaped cross-section which is preferably (although not necessarily) open at the ends for introduction of the insert 7. According to an example embodiment, the insert 7 is integral, i.e. formed as one piece, with the guide 81 or, more generally, with the frame 8.

The two pairs of brackets 82 connect the elongated guide 81 to the second shaft 83. In the preferred embodiment shown in the various figures, the second shaft 83 is formed as two sections 83*a* and 83*b*. The second shaft 83 defines a second axis of rotation 88. When the suction nozzle 1 is assembled, the ends of the two sections 83*a* and 83*b* are supported by the holes 23 in the pillars 21 and by the holes 24 in the supports 24.

An engaging surface 85, 86 cooperating with the projecting tongues 98, 99 (FIGS. 10, 11 and 12) is provided between two brackets 82. Each engaging surface 85, 86 comprises a surface portion in the form of an arc of a circle (when viewed in cross-section) defined as a result of rotation of the tongues 98, 99. In order to define the form of this circle-arc surface, a certain angle of rotation of the pedal shaft (according to the example embodiment, about 45°) is established and an arc of a circle traveled along by the edge of the tongue 98, 99 is traced when the first shaft 91 rotates about the first axis 94. The circle-arc surface of the engaging surface 85, 86 about the second axis 88 corresponds substantially to the arc traced by the tongue 98, 99. The end of rotation occurs when the frame 8 comes into contact with the base plate 2. In this position, the point of contact between the tongue and the engaging surface has passed beyond the point where the straight line perpendicular to the engaging surface passes through the centre of rotation of the pedal so as to generate a moment which tends to cause the pedal to rotate even more. The pedal cannot rotate beyond a certain limit because there is an end-of-travel stop (usually it is the covering body which acts as an end-of-travel stop).

Two plates 87 are integral with innermost brackets 82. Each plate 87 has a suitably shaped hole 89. When the suction nozzle 1 is assembled, two cylindrical compression springs 26 are mounted on the pins 25 of the base plate 2 and are retained between the base plate and the holed plates 87. The end-of-travel function is performed by the pins 25 which, given their length, prevent the frame 8 from rotating beyond a certain limit. End-of-travel stops may also be provided on the body. The function of the springs 26 is that of keeping the frame 8 raised in the rest position. Owing to the nature and the kinematics of the mechanism according to the example embodiment, the springs 26 must have a rigidity merely sufficient to support the weight of the frame and the insert.

Figure 5:
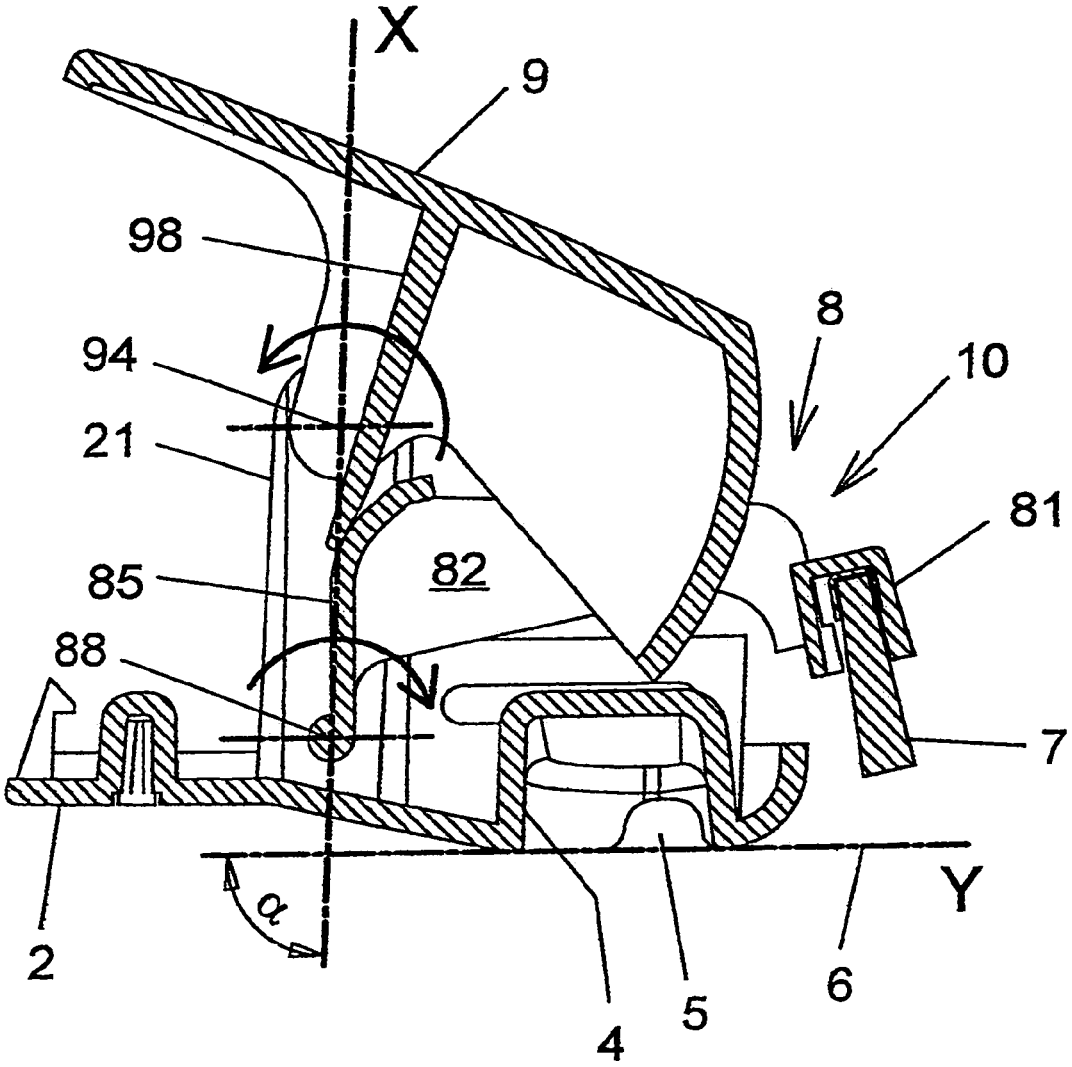
FIG. 5 is an enlarged view of FIG. 4.6.

According to the example embodiment, as clearly shown in FIG. 5, the first axis of rotation 94 (that of the pedal) and the second axis of rotation 88 (that of the support) lie in a same plane X perpendicular to the plane Y of the base plate 2. For the purposes of the present patent application, the "plane of the base plate" is defined by resting the base plate 2 on a flat surface 6, which is the surface to be cleaned, substantially as shown in FIG. 5.

Although it is preferable for the plane X and the plane Y of the base plate to be substantially perpendicular, a variation of about ±10° is considered to be within the scope of protection of the technology disclosed herein. Therefore, the angle α (alpha) indicated in FIG. 5 varies between about 80 and about 100°. Typical values of α (alpha) may be, expressed in degrees, 80, 81, 82, 83, 84, 85, 86, 87, 88, 89, 90, 91, 92, 93, 94, 95, 96, 97, 98, 99, 100.

Raising of the insert 7, by means of rotation of the frame 8, is described with reference to FIGS. 4 and 5. In FIG. 4.1, the insert 7 is completely lowered so as to exert a wiping action and keep the brush 1 raised from the surface 6 to be cleaned (not shown in FIGS. 4). When the pedal 9 is rotated in the clockwise direction through about 10° (FIG. 4.2), the free edge of the projecting tongues starts to slide against the respective engaging surfaces and raising of the insert 7 commences. When the pedal 9 is further rotated in the clockwise direction (FIG. 4.3), the free edge of the projecting tongues engages with the respective engaging surface in a lower position.

After a rotation through about 25°, the projecting tongues have passed from an inclination towards the right (FIG. 4.3 shows the situation after 20°, where the configuration in FIG. 4.1 is regarded as being equal to 0°) to an inclination in the opposite direction (FIG. 4.4 shows the situation after 30°). In the successive positions shown in FIGS. 4.5 and 4.6 (rotation through 40° and 45°, respectively), the projecting tongues are engaged with the respective engaging surfaces no longer by means of their edge, but by means of the side. In the position where the insert 7 is completely raised, the pedal rests against the base plate and the pedal is at the end of its travel path.

The frame 8 for the insert 7 is kept pushed upwards by the two cylindrical springs 26 mounted on the pins 25 of the base plate 2. It should be noted, in other words, that the springs of the mechanism 10 according to the present embodiment have mainly the object of keeping the insert in the position shown in FIG. 5, counteracting the moment generated by the intrinsic weight of the insert 7 and its frame 8.

As may be noted, the movement of the mechanism 10 is fluid, i.e. there is no tooth or step to be overcome and therefore the noise produced as a result of operation of the pedal 9 is much less than the noise of the similar mechanisms known previously.

The position where the insert 7 is lowered is stable and there is no risk of the insert being released following a knock against an obstacle (for example, a wall).

The Applicant has established that there is a very small amount of wear between the projecting tongues 98, 99 and the respective engaging surfaces 85, 86.

Finally, relatively soft springs, which are low-cost and easily to mount, may be used.

Numerous possibilities for modification and replacement of parts with other functionally equivalent parts may occur to a person skilled in the art. However, any such modifications and replacements are regarded as falling within the scope of protection of the present invention which is limited solely by the claims which follow.

The invention claimed is:

1. An improved mechanism for moving a wiping/raising insert of a suction nozzle for a vacuum cleaner, the suction nozzle comprising a base plate, said mechanism for moving the insert comprising:

an operating pedal;

a frame configured to support the insert and to bring the insert from a first working position into a second rest position, said pedal being configured to rotate about a first axis of rotation and said frame being configured to rotate about a second axis of rotation;

wherein said first axis of rotation and said second axis of rotation lie in a plane inclined at an angle ranging between 80° and 100° with respect to a plane of the base plate, the plane of the base plate being a flat surface to be cleaned with the base plate rests on the flat surface to be cleaned: and wherein the pedal is connected to a first rotational shaft and said first rotational shaft comprises at least one projecting tongue, and preferably a pair of projecting tongues.

2. The mechanism according to claim 1, wherein the plane in which the first and the second axes of rotation lie is inclined at an angle of about 90° with respect to a plane of the base plate.

3. The mechanism according to claim 1, wherein said projecting tongues has a thickness which tapers towards a free end and have a terminal edge.

4. The mechanism according to claim 3, wherein the terminal edge of each tongue comprises at least one terminal edge protuberance, and typically two or three equidistant protuberances, so as to offer a reduced terminal edge surface area.

5. The mechanism according to claim 1, wherein said frame comprises:

a guide inside of which the insert is seated;

a second rotational shaft;

brackets configured to connect said second shaft to said guide; and at least one engaging surface configured to cooperate with said at least one tongue.

6. The mechanism according to claim 5, further comprising two engaging surfaces configured to cooperate with two corresponding tongues.

7. The mechanism according to claim 6, wherein each engaging surface extends between two brackets.

8. The mechanism according to claim 1, wherein said frame comprises holed plates configured to cooperate with centering pins of the base plate.

9. The mechanism according to claim 8, further comprising resilient members configured to cooperate with said centering pins and with said holed plates, in order to keep said insert raised in the second rest position.

10. The mechanism according to claim 5, wherein said second shaft of the frame comprises two shaft sections.

11. The mechanism according to claim 10, wherein the first and the second shaft are pivotably mounted in respective holes formed in pillars on the base plate, said second shaft being also pivotably mounted on further intermediate supports.

12. The mechanism according to claim 1, wherein the first shaft is substantially in the form of a cam shaft with a central crank.

13. A suction nozzle for a vacuum cleaner, comprising:

a base plate;

a wiping/raising insert;

a mechanism configured to move the wiping/raising insert, the mechanism comprising:

a frame configured to support the insert and to bring the insert from a first working position into a second rest position;

an operating pedal which is rotatable about a first axis of rotation;

wherein said frame is rotatable about a second axis of rotation;

wherein said first axis of rotation and said second axis of rotation lie in a plane inclined at an angle ranging between 80° and 100° with respect to a plane of the base plate, the plane of the base plate being a flat surface to be cleaned with the base plate rests on the flat surface to be cleaned; and wherein the pedal is connected to a first rotational shaft and said first rotational shaft comprises at least one projecting tongue, and preferably a pair of projecting tongues.

* * * * *